US011371264B2

(12) United States Patent
Zhang

(10) Patent No.: US 11,371,264 B2
(45) Date of Patent: Jun. 28, 2022

(54) FENCE GATE LIMITING MECHANISM, FENCE GATE ASSEMBLY AND FENCE GATE LIMITING METHOD

(71) Applicant: Ningbo Eudemon Child Protective Equipment Co., Ltd., Zhejiang (CN)

(72) Inventor: Zhen Zhang, Zhejiang (CN)

( * ) Notice: Subject to any disclaimer, the term of this patent is extended or adjusted under 35 U.S.C. 154(b) by 190 days.

(21) Appl. No.: 16/587,920

(22) Filed: Sep. 30, 2019

(65) Prior Publication Data

US 2021/0062550 A1 Mar. 4, 2021

(30) Foreign Application Priority Data

Aug. 27, 2019 (CN) ..... 201910795763.2
Aug. 27, 2019 (CN) ..... 201921401350.3

(51) Int. Cl.
*E06B 9/04* (2006.01)
*E05B 65/00* (2006.01)
*E06B 9/00* (2006.01)

(52) U.S. Cl.
CPC ..... *E05B 65/0014* (2013.01); *E06B 9/04* (2013.01); *E06B 2009/002* (2013.01)

(58) Field of Classification Search
CPC ..... E06B 2009/002; E06B 9/04; E06B 9/02; E06B 11/02; E05B 65/0014; E05B 65/0007
See application file for complete search history.

(56) References Cited

U.S. PATENT DOCUMENTS 7,334,624 B2 * 2/2008 Waldman ..... E05B 17/2053 160/144
7,540,046 B1 * 6/2009 Lai ..... A47D 13/065 256/26
7,963,575 B2 * 6/2011 Mayo ..... E06B 9/04 292/169
8,347,555 B2 * 1/2013 Chen ..... E05B 65/0007 49/394
8,615,928 B2 * 12/2013 Wang ..... E04H 17/00 49/226
8,615,931 B2 * 12/2013 Dunn ..... E05B 1/00 49/465
8,713,851 B2 * 5/2014 Flannery ..... E05B 65/0007 49/55
8,733,017 B2 * 5/2014 Marsden ..... E06B 9/02 49/55
9,464,467 B1 * 10/2016 Flannery ..... E05C 1/085
9,637,959 B2 * 5/2017 Marsden ..... E05B 65/0014
9,822,585 B2 * 11/2017 Flannery ..... E06B 9/02
(Continued)

*Primary Examiner* — Justin B Rephann
(74) *Attorney, Agent, or Firm* — Rumit Ranjit Kanakia

(57) ABSTRACT

The invention belongs to the technical field of protective articles for infants and young children, and particularly relates to a fence gate limiting mechanism, a fence gate assembly and a fence gate limiting method which can be suitable for protective devices such as fence gates. In the invention, the traditional dual-operation unlocking is transformed into two-stage unlocking, which eliminates the occurrence of unauthorized opening of the gate assembly by infants and young children. The invention also provides a novel connection mechanism with desirable structural strength and connection strength, which reduces the labor intensity and improves the assembly efficiency in production, assembly and maintenance.

20 Claims, 10 Drawing Sheets

(56) References Cited

U.S. PATENT DOCUMENTS

| | | | | |
|---|---|---|---|---|
| 10,450,795 | B2 * | 10/2019 | Raffi | E05C 19/06 |
| 10,774,587 | B2 * | 9/2020 | Flannery | E06B 3/36 |
| 10,907,382 | B2 * | 2/2021 | Raffi | E05B 63/14 |
| 10,934,769 | B2 * | 3/2021 | Flannery | E06B 11/02 |
| 11,041,340 | B1 * | 6/2021 | Flannery | E06B 11/02 |
| 2002/0002795 | A1 * | 1/2002 | Rogers | E06B 9/04 49/57 |
| 2003/0009945 | A1 * | 1/2003 | Cheng | E05F 1/1223 49/57 |
| 2005/0028947 | A1 * | 2/2005 | Waldman | E05B 65/0014 160/215 |
| 2006/0207180 | A1 * | 9/2006 | Cheng | E05B 65/0014 49/57 |
| 2008/0191497 | A1 * | 8/2008 | Mayo | E06B 9/04 292/169 |
| 2009/0064595 | A1 * | 3/2009 | Yates | E05B 65/0014 49/506 |
| 2012/0255234 | A1 * | 10/2012 | Wang | E05C 19/16 49/395 |
| 2018/0148954 | A1 * | 5/2018 | Raffi | E06B 11/02 |
| 2021/0062550 | A1 * | 3/2021 | Zhang | E05B 65/0007 |

* cited by examiner

FENCE GATE LIMITING MECHANISM, FENCE GATE ASSEMBLY AND FENCE GATE LIMITING METHOD

FIELD OF THE INVENTION

The invention belongs to the technical field of protective articles for infants and young children, and particularly relates to a fence gate limiting mechanism, a fence gate assembly and a fence gate limiting method which can be suitable for protective devices such as fence gates.

BACKGROUND OF THE INVENTION

With the development of society and the improvement of living standards, people's safety awareness is gradually increasing. Especially for the safety protection of infants and young children, the related safety devices have been continuously upgraded in recent years. Generally, infants and young children over one year old can walk on their own or along the wall, which will bring some troubles for daily care; therefore, people have developed protective articles such as fence gates and fences to limit the activity areas of infants and young children, so that infants and young children can only move within specified areas or are not allowed to enter some risk areas (e.g. kitchens).

Most of similar existing protective devices such as fence gates or fences have an openable gate, which is generally provided with two-button unlocking to prevent infants and young children from opening by themselves; i.e. a child lock button needs to be opened and then an unlock button is operated to open the gate, and even for some products, a force needs to be continuously applied to a child lock button to ensure that the gate can be opened. For example, in Invention Patent No. 201420436205.X entitled "Safe Fence Gate" filed in 2014 by the applicant, a gate can be unlocked by simultaneously holding an upper button 5 (i.e. an unlock button) and a lower button 6 (i.e. a child lock button) on a handle body 4 to open an upper lock cylinder 41.

Such structural arrangement reduces the probability of misoperation by infants and young children to some extent, but cannot have a very sufficient preventive effect in practice; and there may also be cases where infants and young children open gates due to their misoperation or imitation of adults' operation. Therefore, it is necessary to redesign the structure of a fence gate assembly and to develop a fence gate limiting mechanism, a fence gate assembly and a fence gate limiting method which can effectively prevent infants and young children from operating by themselves.

SUMMARY OF THE INVENTION

An object of the invention is to provide a fence gate limiting mechanism, a fence gate assembly and a fence gate limiting method with two-stage unlocking which can effectively prevent infants and young children from operating and opening by themselves.

As a first aspect of the invention, a fence gate limiting mechanism is provided, which comprises a first limiting assembly and a second limiting assembly that cooperate with each other to achieve a limiting function, wherein the first limiting assembly comprises a lock tongue and an actuating member, and the second limiting assembly comprises a limiting seat; the limiting seat comprises a first limiting seat, and the fence gate limiting mechanism comprises a guiding portion arranged on the limiting seat or the lock tongue; and the lock tongue is fitted into the first limiting seat and forms primary limiting and secondary limiting, wherein the primary limiting is controlled by the actuating member and the secondary limiting is acted on by the guiding portion to drive the displacement of the lock tongue.

Preferably, the limiting seat further comprises a second limiting seat, and the first limiting seat and the second limiting seat are adjacently arranged; the depth of the first limiting seat is greater than that of the second limiting seat, and the lock tongue forms primary limiting when fitted to the first limiting seat and secondary limiting when fitted to the second limiting seat; and the guiding portion is also arranged on the limiting seat or the lock tongue.

For the fence gate limiting mechanism, the traditional dual-operation unlocking is transformed into two-stage unlocking, wherein the actuating member is manipulated in the primary stage to complete primary unlocking, and the first limiting assembly is longitudinally lifted or pressed while maintaining the primary unlocking to complete later-stage unlocking. Such unlocking mode and structure are novel. Due to the limited height, strength and intellectual development level of infants and young children, the operation of longitudinal lifting or pressing required for the later-stage unlocking of the fence gate limiting mechanism cannot be completed and imitated by infants and young children, which can effectively prevent infants and young children from opening by misoperation and significantly improve the safety, compared with the operation in a traditional two-button limiting mechanism. The fence gate limiting mechanism can be either applied to the improved fence gate assembly of the invention, or fitted to a traditional fence gate to enhance its safety.

As a second aspect of the invention, a fence gate assembly is provided, which comprises an outer frame assembly and a gate assembly, and further comprises an upper rotating shaft mechanism, a lower rotating shaft mechanism and a limiting mechanism. The upper rotating shaft mechanism comprises a rotating shaft seat and an adapter, wherein the adapter is connected to the gate assembly via a connection mechanism. The fence gate connection mechanism comprises a first body and a second body, a chamber for providing a first frame of the gate assembly therein is formed between the first body and the second body, and the first body and the second body are also respectively provided with a fixing post and a fixing hole; and the fixing post penetrates through the first frame and is fitted into the fixing hole when the connection mechanism is fitted to the gate assembly.

Preferably, the limiting mechanism is also any fence gate limiting mechanism of the first aspect of the invention to limit the gate assembly. More preferably, the first limiting assembly is also connected to the gate assembly via the fence gate connection mechanism.

As a third aspect of the invention, a fence gate limiting method is provided, which comprises:

configuring a fence gate assembly to have relevant functional components such as an outer frame assembly, a gate assembly and a limiting mechanism (comprising a first limiting assembly and a second limiting assembly); and configuring the lock tongue to be fitted into a first limiting seat and to form primary limiting and secondary limiting, wherein the primary limiting is controlled by an actuating member and the secondary limiting is acted on by a guiding portion.

Preferably, the limiting seat is configured to further comprise a second limiting seat, and the lock tongue forms primary limiting when fitted to the first limiting seat and secondary limiting when fitted to the second limiting seat.

For the limiting mechanism, the fence gate assembly and the fence gate limiting method of the invention, it is mainly intended to reform the limiting mechanism, wherein the traditional dual-operation unlocking is transformed into two-stage unlocking, i.e. the actuating member is manipulated in the primary stage to perform primary unlocking, and the first limiting assembly is longitudinally lifted or pressed while maintaining the primary unlocking to perform secondary unlocking, so that the relative limiting between the two limiting assemblies is unlocked. Such unlocking mode and structure are original and novel. Considering the limited height, strength and intellectual development level of infants and young children, the operation required for secondary unlocking cannot be completed by infants and young children, and thus the fence gate assembly of the invention eliminates the occurrence of unauthorized opening of the gate assembly by infants and young children due to their misoperation or imitation of adults' operation, and its safety is also obviously improved compared with that of a traditional limiting mechanism.

In addition, the main components of the fence gate assembly of the invention are connected by a specially designed connection mechanism which is connected to the gate assembly by penetrating the fixing post through the frame of the gate assembly, and the two parts can be firmly connected when the fixing post is fitted to the fixing hole, which can withstand the force applied in left and right opening directions, upward and downward lifting or pressing directions and the like, and ensure firm connection; in combination with a preferred frame fixing seat and reinforcing ribs, the structural strength of the connection mechanism and its connection strength with the gate assembly can meet the use demand for the main components of a fence gate; and in particular, when the components are connected by means of engagement, the requirement can also be met, the labor intensity in the assembly and maintenance process can also be significantly reduced and the efficiency is improved. Therefore, the connection mechanism can reduce the labor intensity and improve the assembly efficiency in its production, assembly and subsequent maintenance process while satisfying the functions required by relevant components of the fence gate.

DETAILED DESCRIPTION OF THE INVENTION

Figure 1:
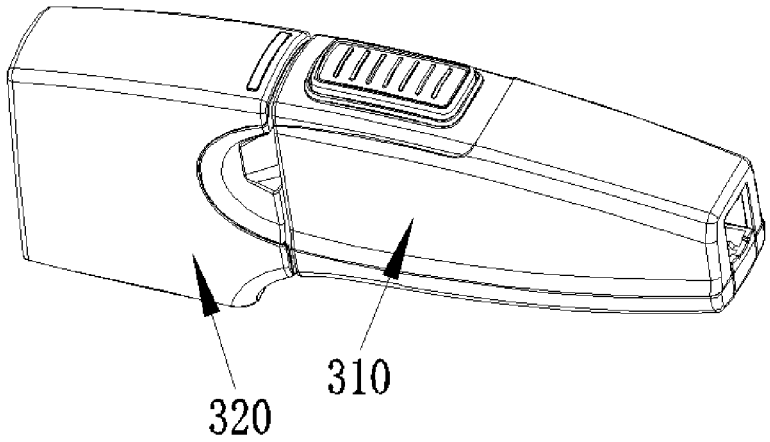
FIG. 1 is a schematic view showing the cooperation of a limiting mechanism of an embodiment of the invention.
Figure 2:
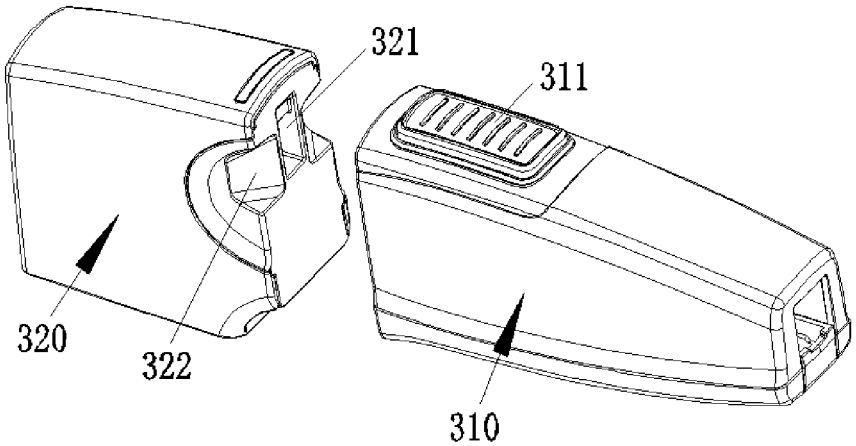
FIG. 2 is a schematic exploded view of the embodiment of FIG. 1.
Figure 3:
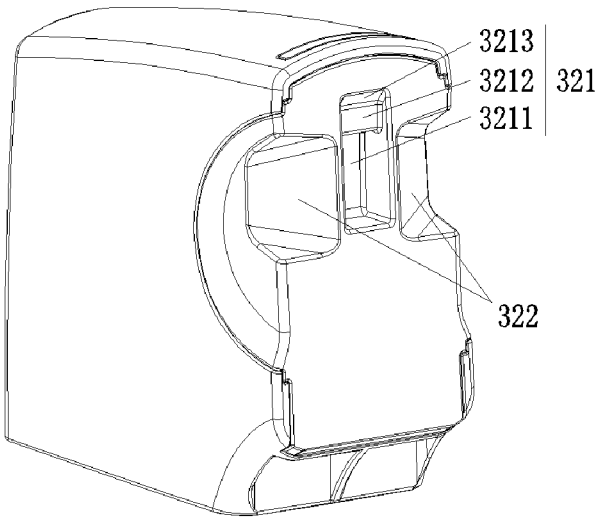
FIG. 3 is a schematic structural view of a second limiting assembly of the embodiment of FIG. 1.

In order that those skilled in the art better understand the invention to define the claimed scope of the invention more clearly, the invention will be described below in detail with reference to some particular embodiments of the invention.

It should be noted that the following description only refers to some particular embodiments within the inventive concept, which are only part of the embodiments of the invention, wherein the detailed direct description of the related structures is only for the convenience of understanding the invention, and various specific features do not certainly and directly define the implementation range of the invention. Conventional selection and substitution made by those skilled in the art under the guidance of the inventive concept shall be considered to be within the claimed scope of the invention.

As shown in FIGS. 1 to 10, a fence gate limiting mechanism is mainly suitable for the limiting of gates of protective products for infants and young children such as fence gates and fences so as to prevent infants and young children from operating and opening the gates by themselves and entering danger areas or getting out of defined activity areas. In general, the limiting mechanism of the invention is a limiting locking device for controlling the opening and closing of a gate.

The limiting mechanism mainly consists of a first limiting assembly 310 and a second limiting assembly 320 that cooperate with each other to achieve a limiting function, wherein the first limiting assembly 310 comprises a lock tongue 312 and an actuating member 311, and the second limiting assembly 320 comprises a limiting seat 321; and the actuating member 311 drives the lock tongue 312 to move in the limiting seat 321, and the lock tongue 312 can be moved close to or away from the second limiting assembly 320 to achieve a locking or unlocking function.

Figure 4:
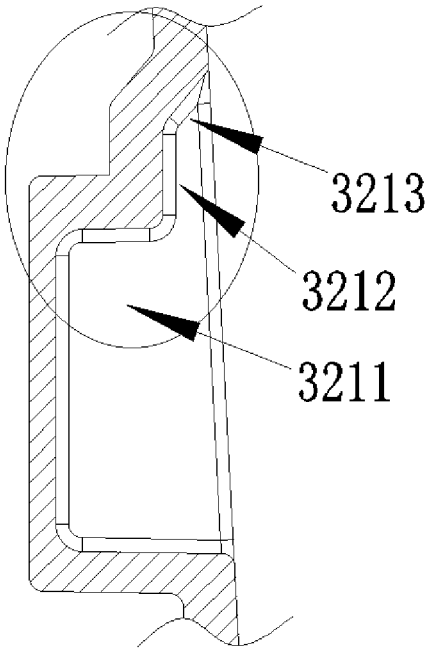
FIG. 4 is a cross-sectional view showing the main functional structure of a limiting seat of FIG. 3.
Figure 5:
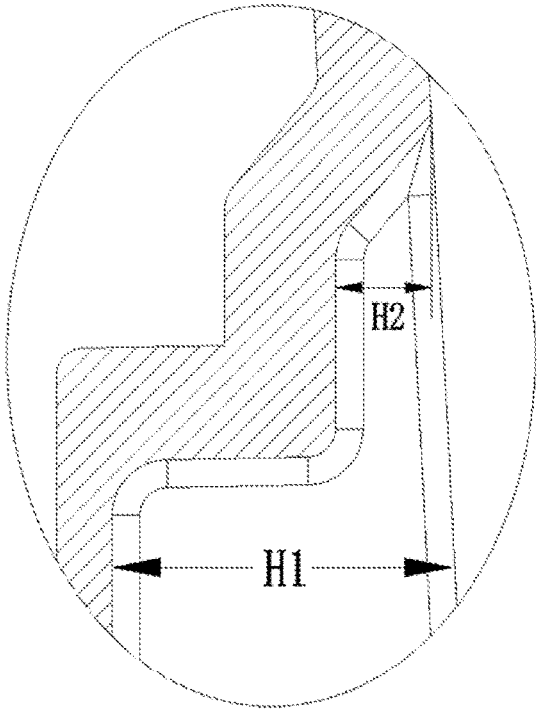
FIG. 5 is a partially enlarged view of FIG. 4.
Figure 6:
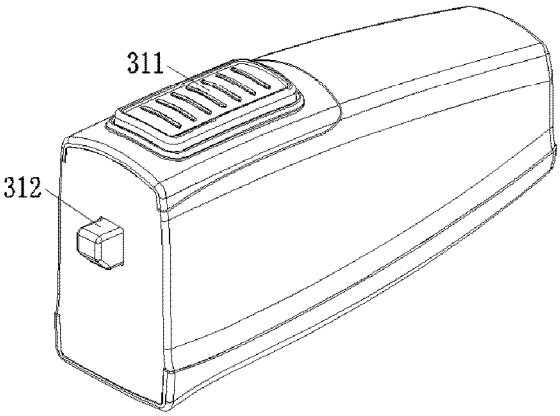
FIG. 6 is a schematic structural view of a first limiting assembly of the embodiment of FIG. 1.
Figure 7:
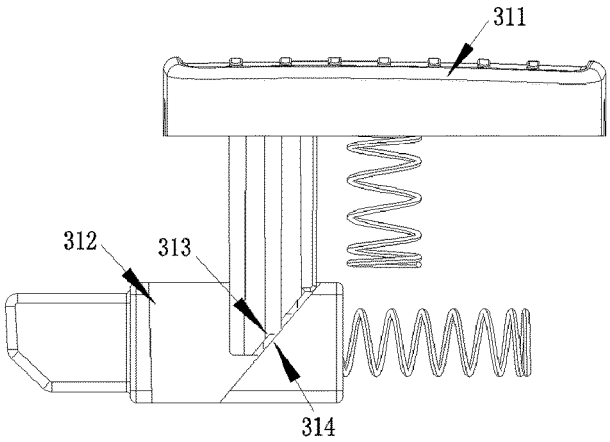
FIG. 7 is a schematic view showing the cooperation among main functional components of the first limiting assembly of FIG. 6.
Figure 8:
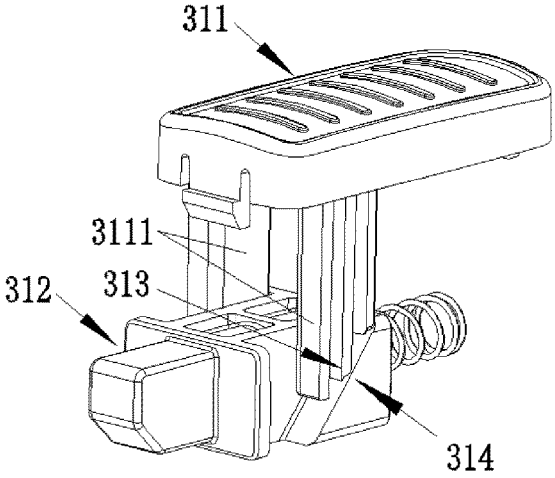
FIG. 8 is a schematic view showing the cooperation between an actuating member and a lock tongue of a preferred embodiment of the invention.
Figure 9:
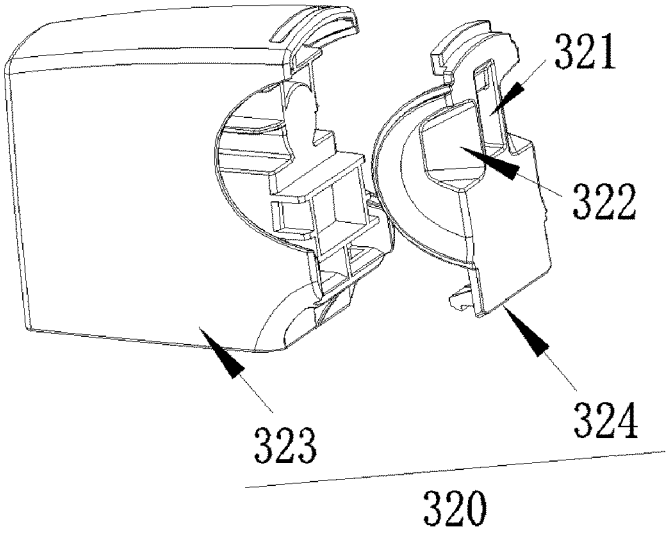
FIG. 9 is a schematic view showing the cooperation between the limiting mechanism and a fence gate of the embodiment of FIG. 1.
Figure 10:
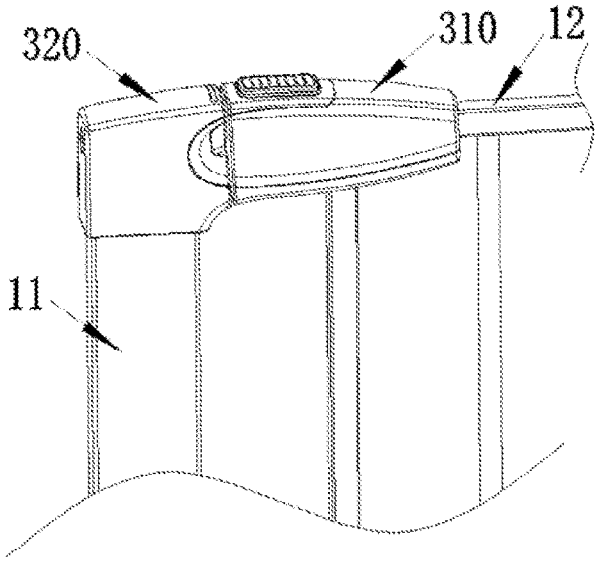
FIG. 10 is a cross-sectional view showing the cooperation between the limiting mechanism and the fence gate of the invention.

The limiting seat 321 comprises a first limiting seat 3211, a second limiting seat 3212 and a guiding portion 3213, wherein the first limiting seat 3211 and the second limiting seat 3212 are adjacently arranged, the depth H1 of the first limiting seat 3211 is greater than the depth H2 of the second limiting seat 3212, a portion (i.e. H1-H2) of the first limiting seat 3211 that is deeper than the second limiting seat 3212 forms a primary limiting area, and the second limiting seat 3212 forms a secondary limiting area. The guiding portion 3213 is arranged on a side of the second limiting seat 3212 away from the first limiting seat 3211, and is flush with an edge of the limiting seat 321, so that the lock tongue 312 can be disengaged from the limiting seat 321; i.e. the first limiting seat 3211, the second limiting seat 3212 and the guiding portion 3213 are sequentially arranged (as shown in FIGS. 4 and 5).

Since the lock tongue 312 is telescopically and movably arranged in the limiting seat 321, and can extend into the limiting seat 321 so that the first limiting assembly 310 and the second limiting assembly 320 are limited relative to each other, while the actuating member 311 is used for driving the lock tongue 312 to partially move in the first limiting seat 3211. Upon unlocking, the actuating member 311 drives the lock tongue 312 to move toward the first limiting seat 3211, so that the depth of the lock tongue 312 inserted into the limiting seat 321 does not exceed the depth H2 of the second limiting seat 3212, and then the actuating member 311 cannot further drive the lock tongue 312 to move toward the first limiting seat 3211 so as to reduce the depth of its insertion into the limiting seat 321; that is, the actuating member 311 can drive the lock tongue 312 to be unlocked from the first limiting seat 3211 of the limiting seat 321, but cannot drive the lock tongue to be unlocked from the second limiting seat 3212 of the limiting seat 321. At this time, the guiding portion 3213 is in a fittable state, i.e. a state in which the guiding portion can provide a guiding action, rather than a selected state of being fittable or non-fittable; and before primary limiting is unlocked, the guiding portion 3213 is in a non-fittable state. The first limiting assembly 310 can be longitudinally moved relative to the second limiting assembly 320, or moved in the arrangement direction of the limiting seat 321 (i.e. from the first limiting seat 3211 to the second limiting seat 3212 to the guiding portion 3213), and the lock tongue 312 contacts the guiding portion 3213, so that under the action of the guiding portion 3213, the telescopically arranged lock tongue 312 is further moved toward the first limiting seat 3211 and then disengaged from the limiting seat 321 to complete secondary unlocking, thereby unlocking the first limiting assembly 310 and the second limiting assembly 320.

It can be seen that the limiting mechanism comprises two operations upon unlocking: the first step (primary unlocking): the actuating member 311 controls the lock tongue 312 to be unlocked from the second limiting seat 3212; and the second step (secondary unlocking): the actuating member 311 is maintained in the unlocked state, so that the first limiting assembly 310 is longitudinally moved relative to the second limiting assembly 320, and the lock tongue 312 is completely disengaged from the limiting seat 321 due to the action of the guiding portion 3213, thereby unlocking the limiting between first limiting assembly 310 and the second limiting assembly 320.

In some particular embodiments, the actuating member 311 comprises a first guiding portion 313, and the lock tongue 312 comprises a second guiding portion 314, wherein the first guiding portion 313 and the second guiding portion 314 are inclined or curved surfaces that match each other, so that the actuating member 311 and the lock tongue 312 can be moved in different directions. More preferably, springs 315 are also respectively arranged between the actuating member 311 and the first limiting assembly 310, and between the lock tongue 312 and the first limiting assembly 310, so that both the actuating member 311 and the lock tongue 312 can be automatically reset; and when the second limiting assembly 320 is reset relative to the first limiting assembly 310, it may be unnecessary to manipulate the actuating member 311 and only an external force is applied to the lock tongue 312 so that the lock tongue can be contracted into the first limiting assembly 310.

In other embodiments, the second limiting assembly 320 further comprises a limiting guiding portion 322; and the limiting guiding portion 322 is an inclined or curved surface which is arranged on a side of the second limiting assembly 320 and arranged adjacently to the limiting seat 321; therefore, in the locking process, the lock tongue 312 is automatically contracted to automatically enter the limiting seat 321 due to the action of the limiting guiding portion 322, thereby enabling the locking of the first limiting assembly 310 and the second limiting assembly 320. Most preferably, two said limiting guiding portions 322 are provided and respectively arranged on both sides of the second limiting assembly 320 to ensure that the first limiting assembly 310 can be automatically locked in any one direction without the need to manipulate the actuating member 311.

In some other embodiments, the second limiting assembly 320 mainly consists of a second limiting body 323 and a limiting member 324 that are fixedly connected, wherein the second limiting body 323 and the limiting member 324 are preferably fixedly connected by means of engagement, screwing or hot melting to form the second limiting assembly 320; and the second limiting body 323 is preferably fixedly connected to an outer frame of a fence gate by means of engagement, screwing or the like.

In addition, in the above embodiments, to facilitate the secondary unlocking operation, primary limiting is implemented at a portion of the first limiting seat 3211 that is deeper than the second limiting seat 3212 and secondary limiting is implemented in the second limiting seat 3212 by the cooperation between the first limiting seat 3211 and the second limiting seat 3212; and after the primary unlocking is completed, the lock tongue 312 can be supported by an inner wall of the second limiting seat 3212 without continuously applying a force to the actuating member 311 to maintain this state. This is a preferred embodiment rather than the only embodiment. If the second limiting seat 3212 is removed and only the first limiting seat 3211 is retained, and the guiding portion 3213 is arranged at the top or bottom thereof, it is also feasible.

Figure 11A:
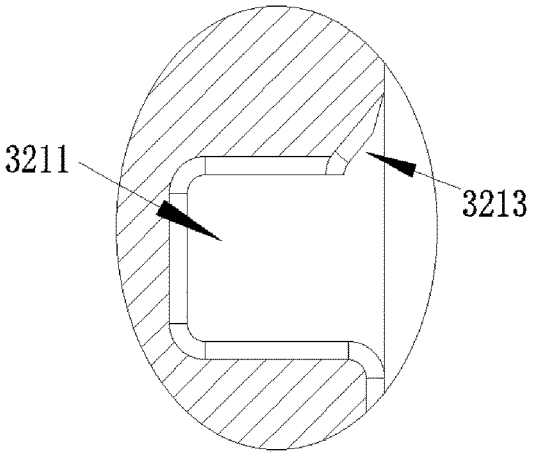
FIG. 11*a* is a cross-sectional view showing the main structure of a limiting seat of another embodiment of the invention.
Figure 11B:
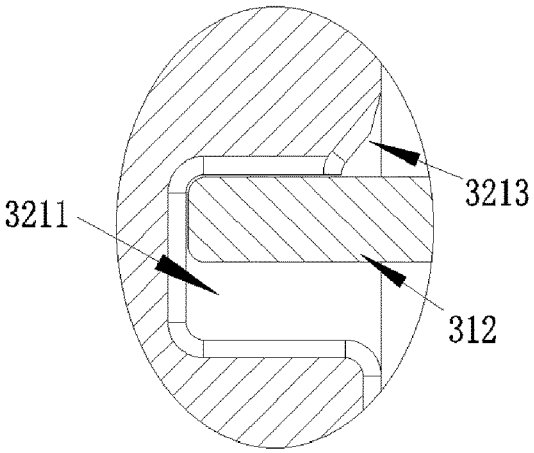
FIGS. 11*b* and 11*c* are schematic views respectively showing primary limiting and secondary limiting of the embodiment of FIG. 11*a;*
Figure 11C:
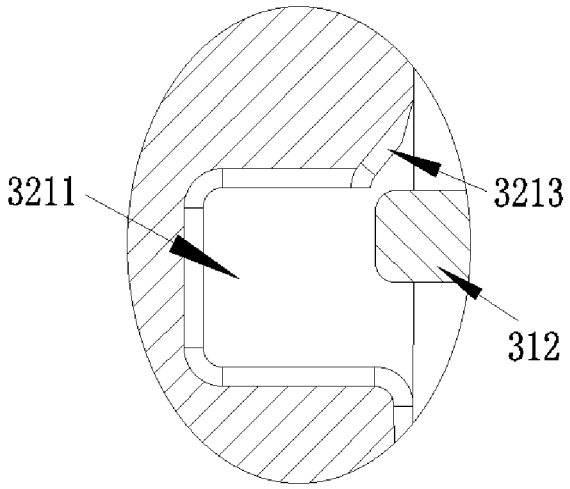

For example, FIG. 11*a* shows a schematic sectional view of a limiting seat that does not comprise the second limiting seat 3212, wherein the guiding portion 3213 is arranged above the first limiting seat 3211. FIGS. 11*b* and 11*c* are respectively schematic views showing the cooperation between a front part of the lock tongue 312 and the limiting seat 321, more precisely, schematic views showing primary limiting and secondary limiting. In the case of the primary limiting shown in FIG. 11*b*, the lock tongue can be contracted to the secondary limiting state shown in FIG. 11*c* by manipulating the actuating member 311, and a force is continuously applied to the actuating member 311 to maintain the lock tongue 312 in this state, i.e. the state shown in FIG. 11*c*, so that the first limiting assembly 310 is longitudinally moved upward relative to the second limiting assembly 320, and the telescopically arranged lock tongue 312 is compressed to be completely disengaged from the limiting seat 321 due to the guiding action of the guiding portion 3213, thereby unlocking the first limiting assembly 310 and the second limiting assembly 320.

Figure 12:
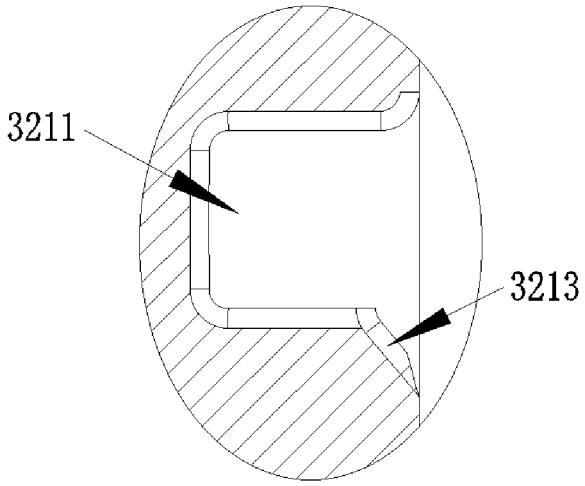
FIG. 12 is a cross-sectional view showing the main structure of a limiting seat of another embodiment of the invention.

In the above embodiments, the guiding portion is arranged on the limiting seat 321 and disposed on an upper part thereof; if the guiding portion is changed to be the inclined or curved surface arranged on the lock tongue 312, the lock tongue 312 can also be compressed by the guiding action of the inclined or curved surface upon secondary unlocking; and more preferably, the guiding portion 3213 can be simultaneously arranged on the limiting seat 321 and the lock tongue 312. However, the arrangement direction of the guiding portion 3213 is not limited to being above the limiting seat 321 or the lock tongue 312. As shown in FIG. 12, the guiding portion is changed to be arranged below to perform unlocking by pressing upon secondary unlocking, which is feasible for the limiting mechanism.

Figure 13:
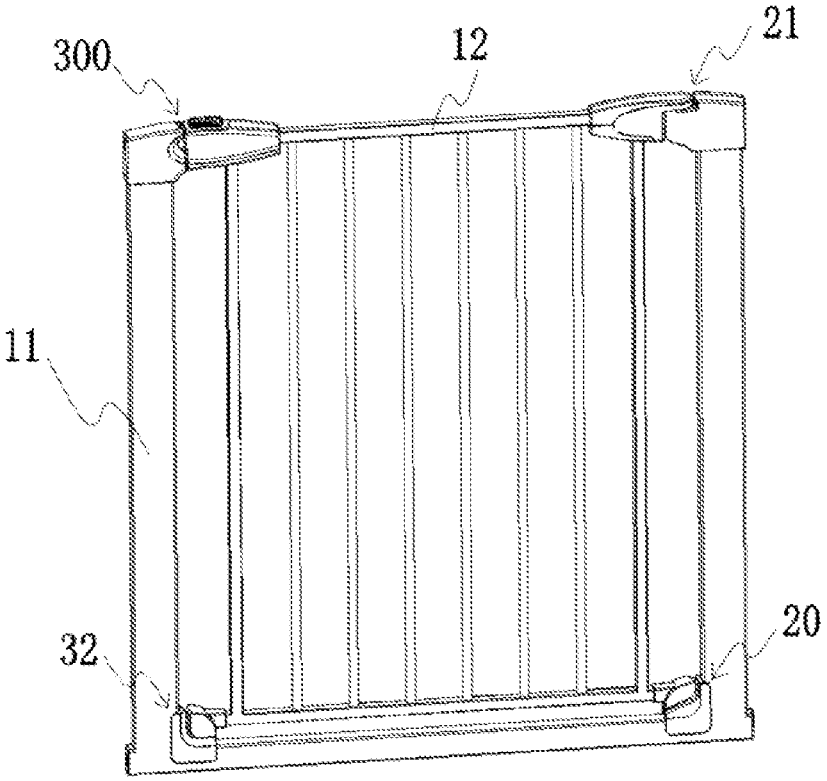
FIG. 13 is a schematic structural view of a fence gate assembly of an embodiment of the invention.
Figure 14:
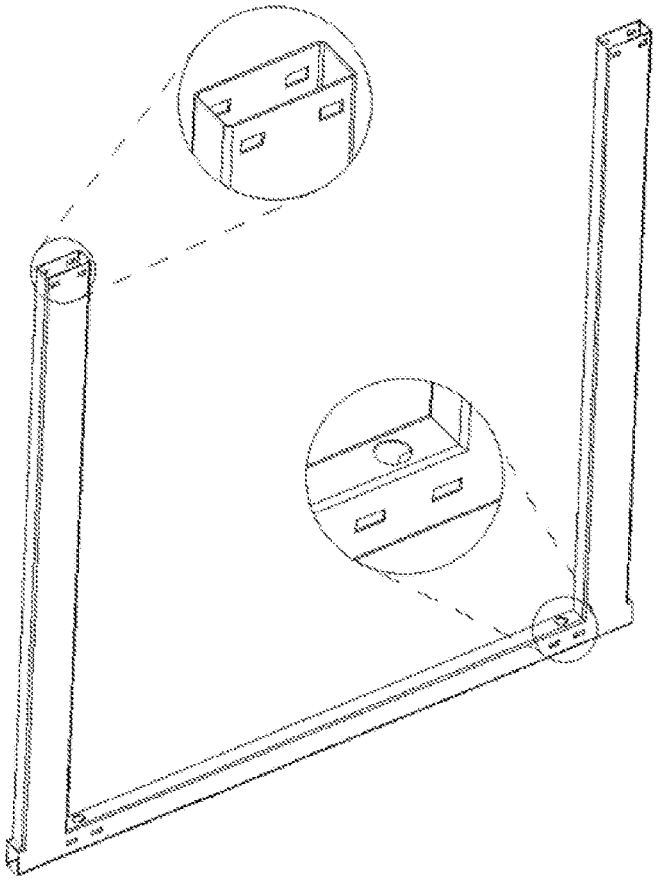
FIG. 14 is a schematic view showing the overall structure of an outer frame assembly of the embodiment of FIG. 13, and is a partially enlarged schematic view of the top and bottom thereof.
Figure 15:
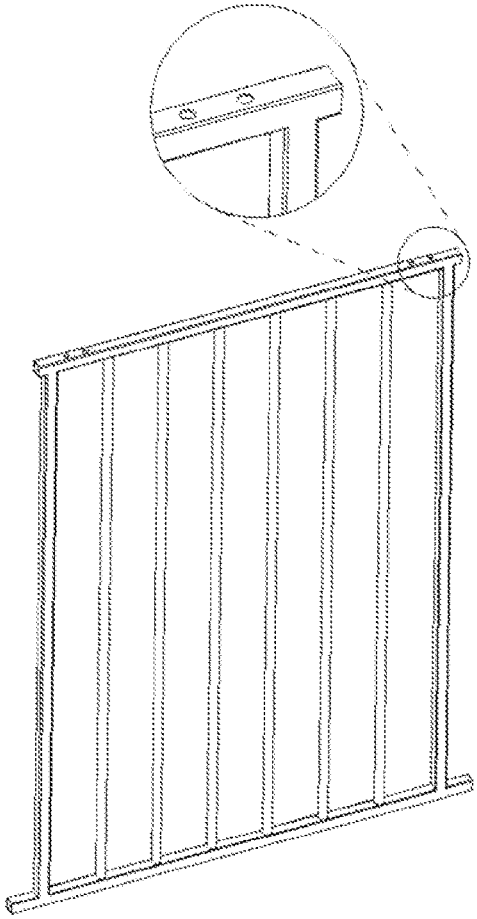
FIG. 15 is a schematic view showing the overall structure of a gate assembly of the embodiment of FIG. 13, and is a partially enlarged schematic view of the top thereof.
Figure 16:
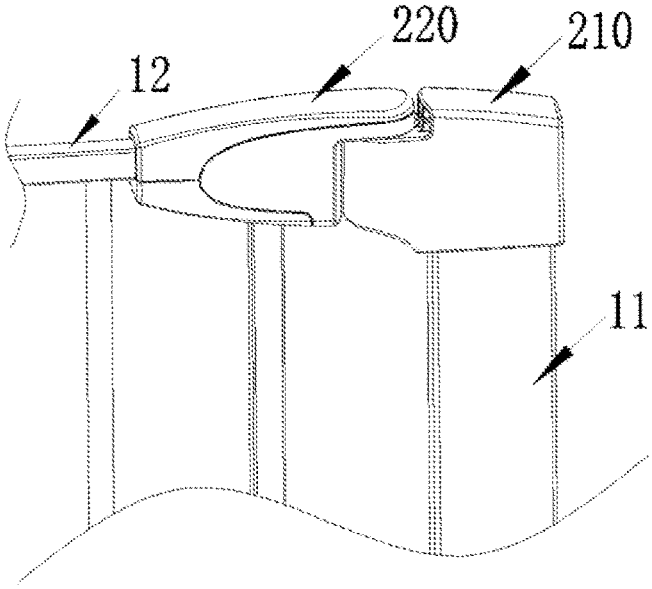
FIG. 16 is a schematic view showing the cooperation between an upper rotating shaft and a gate frame of the embodiment of FIG. 13.
Figure 17:
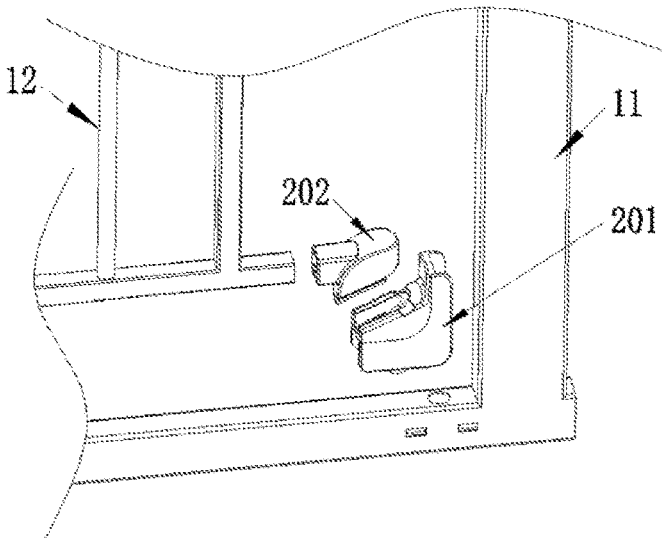
FIG. 17 is a schematic exploded view showing the cooperation between a lower rotating shaft and the gate frame of the embodiment of FIG. 13.
Figure 18:
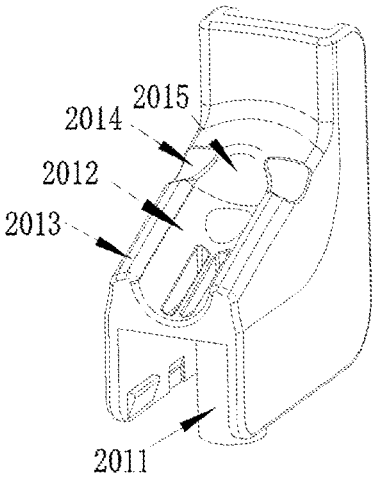
FIGS. 18 and 19 are respectively schematic structural views of a lower rotating shaft seat and a lower rotating shaft member in FIG. 17.
Figure 19:
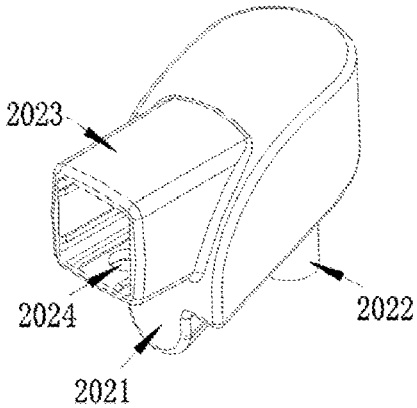
Figure 20:
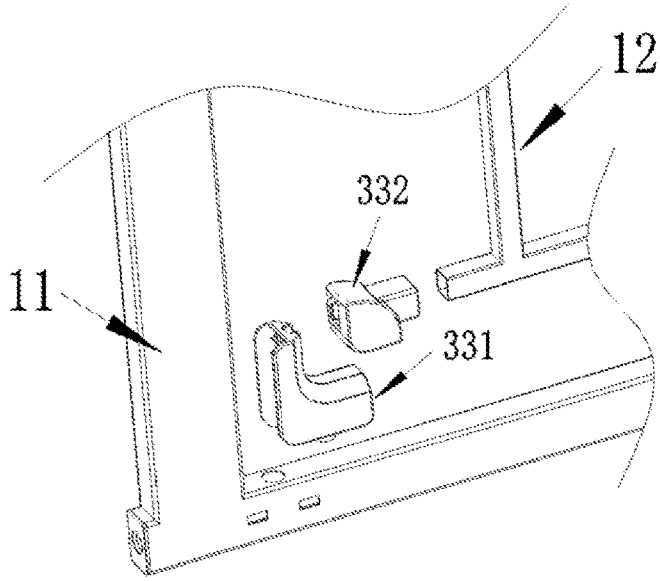
FIG. 20 is a schematic exploded view showing the cooperation between a lower limiting mechanism and the gate frame of the embodiment of FIG. 13.
Figure 21:
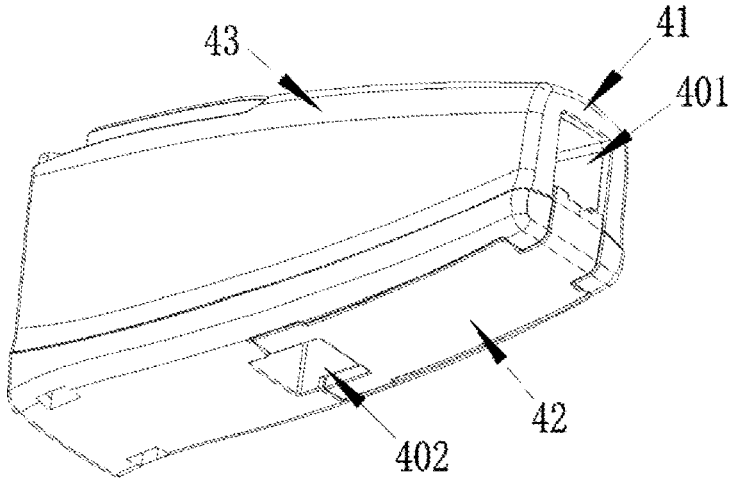
FIG. 21 is a schematic structural view of a connection mechanism for connecting the main functional components of the first limiting assembly of the limiting mechanism to a frame.
Figure 22:
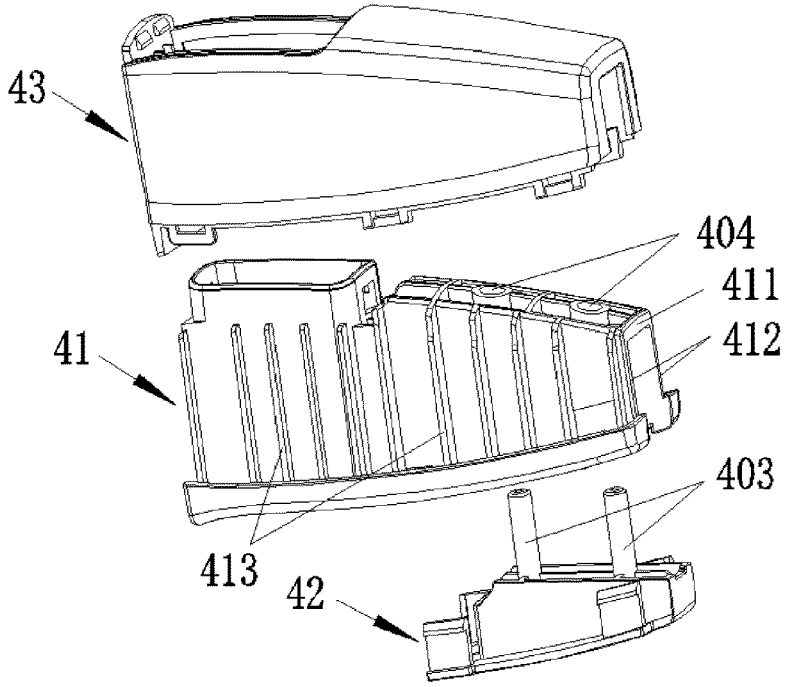
FIG. 22 is a schematic structural exploded view of FIG. 21.

As shown in FIGS. 13 to 31, a fence gate assembly comprises an outer frame assembly 11 for integral fixing and a gate assembly 12 for opening or closing the fence gate, wherein the outer frame assembly 11 is integrally U-shaped as shown in FIGS. 13 and 14, and the gate assembly 12 is openably/closably arranged in the outer frame assembly 11, thereby enabling the opening or closing of the fence gate assembly as a whole.

The fence gate assembly further comprises an upper rotating shaft mechanism 21 and a lower rotating shaft mechanism 20 for forming a rotating shaft, and a limiting mechanism 300 for limiting, wherein the upper rotating shaft mechanism 21 cooperates with the lower rotating shaft mechanism 20 so that the gate assembly 12 is openably/closably arranged in the outer frame assembly 11. More preferably, the fence gate assembly further comprises a lower limiting mechanism 33 for limiting to limit the position below the gate assembly 12 so as to enhance the limiting effect. The upper rotating shaft mechanism 21 comprises a rotating shaft seat 210 and an adapter 220, wherein the rotating shaft seat 210 cooperates with the adapter 220 so that the adapter 220 can be rotated around the rotating shaft seat 210, thereby achieving the basic function of the rotating shaft mechanism.

The limiting mechanism 300 is the fence gate limiting mechanism shown in FIGS. 1 to 10 (i.e. the above fence gate limiting mechanism is used), which mainly consists of a first limiting assembly 310 and a second limiting assembly 320 that cooperate with each other to achieve a limiting function, wherein the first limiting assembly 310 and the second limiting assembly 320 are respectively arranged on the outer frame assembly 11 and the gate assembly 12, thereby enabling the limiting and locking of the gate assembly 12 relative to the outer frame assembly 11.

The adapter 220 and the rotating shaft seat 210 are respectively provided with a shaft body 231 and shaft hole 232 that cooperate with each other, but the position of the shaft body 231 and the shaft hole 232 is not limited, and the shaft body 231 is disposed in the shaft hole 232, so that the adapter 220 can be rotatably arranged relative to the shaft seat 210. More preferably, the rotating shaft mechanism further comprises a cap 233 that cooperates with a free end of the shaft body 231, e.g. by means of engagement, threading or the like, and the outer diameter of the cap 233 is greater than that of the shaft body 231 after cooperation; and a limiting member 2321 is also arranged at a connecting end of the shaft hole 232 near the shaft body 231, and the inner diameter of the limiting member is smaller than the outer diameter of the cap 233, so that shaft body 231 is relatively fixed to the shaft hole 232. That is, the shaft body 231 can be rotated in the shaft hole 232 and can have a certain degree of axial displacement.

In addition, although FIGS. 26 to 30 show a particular embodiment in which an upper end of the shaft body 231 is connected to the adapter 220 to form a connecting end thereof, a lower end thereof is engaged with the cap 233, the rotating shaft seat 210 comprises the shaft hole 232 and the limiting member 2321 is arranged at an upper end of the shaft hole, it does not indicate that the above components must be thus arranged, and the shaft body 231 and the shaft hole 232 are also obviously feasible. Most preferably, the rotating shaft mechanism further comprises a spring 234 fitted outside the shaft body 231, wherein both ends of the spring respectively abut against the limiting member 2321 and the cap 233, so that the adapter 220 can be rotated and have a certain degree of axial displacement relative to the rotating shaft seat 210, and can also be automatically reset axially.

The lower rotating shaft mechanism 20 comprises a lower rotating shaft seat 201 and a lower rotating shaft member 202, wherein the lower rotating shaft seat 201 has an edge to be engaged on the outer frame assembly 11, and further comprises a positioning post 2011 to enhance the fixing and positioning effects, the outer frame assembly 11 is correspondingly provided with a positioning hole, and the positioning post 2011 is fitted into the positioning hole; and the positioning post 2011 is hollow inside for further providing a rotating post 2022 of the lower rotating shaft seat 201 therein. The lower rotating shaft seat 201 is provided with an inclined fixing slot 2012, a fixing hole 2015 is arranged at an end of the fixing slot 2012, steps 2013 are arranged on both sides of the fixing slot 2012, and two positioning holes 2014 are arranged at the steps 2013 near the fixing hole 2015. A fixing edge 2021 and the rotating post 2022 are arranged at the bottom of the lower rotating shaft member 202. The fixing edge 2021 cooperates with the fixing slot 2012. The rotating post 2022 is fitted into the positioning post 2011 for rotation. The lower rotating shaft member 202 further comprises a connecting member 2023 for being connected to the gate assembly 12, and the connecting member 2023 is provided with an auxiliary positioning hole 2024.

Upon assembling, one end of a lower horizontal frame of the gate assembly 12 is fitted into the connecting member 2023, and an auxiliary positioning mechanism (e.g. a combination of a spring and a post widely used in a telescopic assembly) arranged on the lower horizontal frame is fitted into the auxiliary positioning hole 2024, so that the lower rotating shaft member 202 is firmly connected to the gate assembly 12; and the lower rotating shaft seat 201 is engaged on the outer frame assembly 11, a clamping block on its edge is inserted into a hole of the outer frame assembly 11, and the positioning post 2011 is fitted into a corresponding positioning hole on the outer frame assembly 11, so that the lower rotating shaft seat 201 is firmly connected to the outer frame assembly 11. The rotating post 2022 of the lower rotating shaft member 202 is then disposed in the hollow positioning post 2011 of the lower rotating shaft seat 201, and the fixing edge 2021 cooperates with the fixing slot 2012. When in use, the gate assembly 12 is unlocked and rotated until the fixing edge 2021 is fitted into the positioning hole 2014, and then the gate assembly 12 is maintained at the opening angle.

The lower limiting mechanism 33 comprises a lower limiting seat 331 and a lower limiting member 332, wherein the lower limiting seat 331 is fixed in a manner similar to the lower rotating shaft seat 201 of the lower rotating shaft mechanism 20, which is not described herein again; and the lower limiting member 332 is connected in the same manner as the lower horizontal frame of the gate assembly 12, and also in a manner similar to the lower rotating shaft member 202. Moreover, the lower limiting member 332 and the lower limiting seat 331 are respectively provided with a lower lock block and a lower lock groove that cooperate with each other to enable the locking of the lower limiting mechanism 33.

The related structures of the first limiting assembly 310 and the second limiting assembly 320 are as described above.

Since the lock tongue 312 is telescopically and movably arranged in the limiting seat 321, and can extend into the limiting seat 321 to form primary limiting and secondary limiting, so that the relative limiting between the first limiting assembly 310 and the second limiting assembly 320 is locked. More specifically, the depth H1 of the first limiting seat 3211 is greater than the depth H2 of the second limiting seat 3212, a portion (i.e. H1-H2) of the first limiting seat 3211 that is deeper than the second limiting seat 3212 forms a primary limiting area, the second limiting seat 3212 forms a secondary limiting area, and the actuating member 311 can only drive the lock tongue 312 to be contracted to move away from the primary limiting area and cannot further drive its contraction. In this case, the lock tongue 312 is still limited by the second limiting seat 3212 and the guiding portion 3213 is in a fittable state, and therefore the longitudinal displacement between the two limiting assemblies 310, 320 can drive the lock tongue 312 to be further contracted and then unlocked from the second limiting seat 3212. Before unlocking, the guiding portion is in a non-fittable state, and therefore the longitudinal displacement between the two limiting assemblies cannot drive the lock tongue 312 to move (the fittable state refers to a state in which the guiding portion can provide a guiding action, rather than a selected state of being fittable or non-fittable).

Therefore, upon unlocking, the actuating member 311 first drives the lock tongue 312 to be contracted and displaced toward the first limiting seat 3211, so that the depth of the lock tongue 312 inserted into the limiting seat 321 does not exceed the depth H2 of the second limiting seat 3212, and then the actuating member 311 cannot further drive the lock tongue 312 to move toward the first limiting seat 3211 so as to reduce the depth of its insertion into the limiting seat 321; that is, the actuating member 311 can drive the lock tongue 312 to be unlocked from the first limiting seat 3211 of the limiting seat 321, but cannot drive the lock tongue to be unlocked from the second limiting seat 3212 of the limiting seat 321, and the lock tongue is still limited in the second limiting seat 3212. When the unlocked state is maintained (after primary unlocking, the lock tongue 312 can be supported by an inner wall of the second limiting seat 3212 to maintain the unlocked state), the first limiting assembly 310 is longitudinally moved relative to the second limiting assembly 320, or moved in the arrangement direction of the limiting seat 321 (i.e. from the first limiting seat 3211 to the second limiting seat 3212 to the guiding portion 3213), and the lock tongue 312 contacts the guiding portion 3213, so that under the action of the guiding portion 3213, the longitudinal displacement between the two limiting assemblies is converted into the contraction movement of the lock tongue 312 to allow the lock tongue to be further moved toward the first limiting seat 3211 and then completely disengaged from the limiting seat 321, thereby unlocking the first limiting assembly 310 and the second limiting assembly 320.

It can be seen that the limiting mechanism comprises two operations upon unlocking: the first step (primary unlocking): the actuating member 311 controls the lock tongue 312 to be unlocked from the first limiting seat 3211, and the lock tongue is limited in the second limiting seat 3212; and the second step (secondary unlocking): the actuating member 311 is maintained in the unlocked state, so that the first limiting assembly 310 is longitudinally moved relative to the second limiting assembly 320, and the lock tongue 312 is further contracted to be completely disengaged from the limiting seat 321 due to the action of the guiding portion 3213, thereby unlocking the limiting between first limiting assembly 310 and the second limiting assembly 320.

Moreover, in the embodiment, to facilitate the secondary unlocking operation, primary limiting is implemented at a portion of the first limiting seat 3211 that is deeper than the second limiting seat 3212 and secondary limiting is implemented in the second limiting seat 3212 by the cooperation between the first limiting seat 3211 and the second limiting seat 3212; and after the primary unlocking is completed, the lock tongue 312 can be supported by an inner wall of the second limiting seat 3212 without continuously applying a force to the actuating member 311 to maintain this state. This is a preferred embodiment rather than the only embodiment. If the second limiting seat 3212 is removed and only the first limiting seat 3211 is retained, and the guiding portion 3213 is arranged at the top or bottom thereof, it is also feasible. For example, FIG. 11*a* shows a schematic sectional view of a limiting seat that does not comprise the second limiting seat 3212, wherein the guiding portion 3213 is arranged above the first limiting seat 3211. FIGS. 11*b* and 11*c* are respectively schematic views showing the cooperation between a front part of the lock tongue 312 and the limiting seat 321, more precisely, schematic views showing primary limiting and secondary limiting. In the case of the primary limiting shown in FIG. 11*b*, the lock tongue can be contracted to the secondary limiting state shown in FIG. 11*c* by manipulating the actuating member 311, and a force is continuously applied to the actuating member 311 to maintain the lock tongue 312 in this state, i.e. the state shown in FIG. 11*c*, so that the first limiting assembly 310 is longitudinally moved upward relative to the second limiting assembly 320, and the telescopically arranged lock tongue 312 is compressed to be completely disengaged from the limiting seat 321 due to the guiding action of the guiding portion 3213, thereby unlocking the first limiting assembly 310 and the second limiting assembly 320.

In addition, although the guiding portion 3213 is arranged above the limiting seat 321 as shown in the drawings, if the guiding portion is changed to be the inclined or curved surface arranged on the lock tongue 312, the lock tongue 312 can also be compressed by the guiding action of the inclined or curved surface upon secondary unlocking; and more preferably, the guiding portion 3213 can also be simultaneously arranged on the limiting seat 321 and the lock tongue 312. Moreover, the arrangement direction of the guiding portion 3213 is not limited to being above the limiting seat 321 or the lock tongue 312. As shown in FIG. 12, the guiding portion is changed to be arranged below to perform unlocking by pressing upon secondary unlocking, which is feasible for the limiting mechanism.

In some particular embodiments, the actuating member 311 comprises a first guiding portion 313, and the lock tongue 312 comprises a second guiding portion 314, wherein the first guiding portion 313 and the second guiding portion 314 are inclined or curved surfaces that match each other, so that the actuating member 311 and the lock tongue 312 can be moved in different directions; and the first guiding portion 313 cooperates with the second guiding portion 314 so that the pressing displacement of the actuating member 311 can be converted into the telescopic displacement of the lock tongue 312, i.e. the displacement of the actuating member 311 arranged in a different direction is converted into the telescopic movement of the lock tongue 312 by the two inclined or curved surfaces that match each other. Of course, if the actuating member 311 is arranged in the displacement direction of the lock tongue 312 to drive the corresponding displacement of the lock tongue 312, it is also a feasible scheme, but the primary unlocking mode is changed. More preferably, springs 315 are also respectively arranged between the actuating member 311 and the first limiting assembly 310, and between the lock tongue 312 and the first limiting assembly 310, so that both the actuating member 311 and the lock tongue 312 can be automatically reset; and when the second limiting assembly 320 is reset relative to the first limiting assembly 310, it may be unnecessary to manipulate the actuating member 311 and only an external force is applied to the lock tongue 312 so that the lock tongue can be contracted into the first limiting assembly 310. Regardless of the design of the actuating member 311, the springs 315 are applicable.

In other embodiments, the second limiting assembly 320 further comprises a limiting guiding portion 322; and the limiting guiding portion 322 is an inclined or curved surface which is arranged on a side of the second limiting assembly 320 and arranged adjacently to the limiting seat 321; therefore, in the locking process, the lock tongue 312 is automatically contracted to automatically enter the limiting seat 321 due to the action of the limiting guiding portion 322, thereby enabling the locking of the first limiting assembly 310 and the second limiting assembly 320. Most preferably, two said limiting guiding portions 322 are provided and respectively arranged on both sides of the second limiting assembly 320 to ensure that the first limiting assembly 310 can be automatically locked in any one direction without the need to manipulate the actuating member 311.

In some other embodiments, the second limiting assembly 320 mainly consists of a second limiting body 323 and a limiting member 324 that are fixedly connected, wherein the second limiting body 323 and the limiting member 324 are preferably fixedly connected by means of engagement, screwing or hot melting to form the second limiting assembly 320; and the second limiting body 323 is preferably fixedly connected to an outer frame of a fence gate by means of engagement, screwing or the like.

In some other preferred embodiments, at least one of the adapter 220 and the first limiting assembly 310 is connected to the gate assembly 12 via a special connection mechanism; and more specifically, the shaft body 231 of the adapter 220, and an integral functional member formed by the actuating member 311 and the lock tongue 312 of the first limiting assembly 310 are respectively arranged on their respective connection mechanisms (if any).

The connection mechanism comprises a first body 41 and a second body 42 that are fixedly connected to form the entire connection mechanism, wherein the first body 41 and the second body 42 are preferably fixedly connected by means of engagement, screwing or hot melting, among which engagement is the most convenient and practical; and a chamber 401 for providing a first frame 121 of the gate assembly therein is formed between the first body 41 and the second body 42, and the first body 41 and the second body 42 are correspondingly provided with a fixing post 403 and a fixing hole 404 respectively, so that the fixing post 403 penetrates through the first frame 121 and is fixed into the fixing hole 404 when the connection mechanism is fitted to the gate assembly, and thus the connection mechanism is firmly fixed to the frame of the gate.

The main fixing effect of the connection mechanism is mainly achieved by the fixing post and the fixing hole, relevant components of the fence gate in use are mainly stressed in side directions such as left and right opening directions, and upward and downward lifting or pressing directions, and the fixing post 403 cooperates with the fixing hole 404 in such a manner that the applied force can be well withstood, so that the two bodies 41, 42 are not disengaged or damaged by the above force; and an end of the fixing post 403 is fitted into the fixing hole 404, so that the force of the connection mechanism in all directions of the gate assembly can be converted into an interaction force between an outer wall of the fixing post 403 and an inner wall of the fixing hole 404 to reduce the stress on engaging members of the two bodies 41, 42, and thus the connection mechanism can exhibit an excellent fixing effect when subjected to an external force, and does not require fixing members such as screws and rivets to meet the fixing requirement. Such cooperation manner makes it possible for the first body and the second body to be well qualified in spite of being fixed by means of engagement, which is verified by the applicant in field testing. In addition, engagement is very convenient in assembling.

Figure 23:
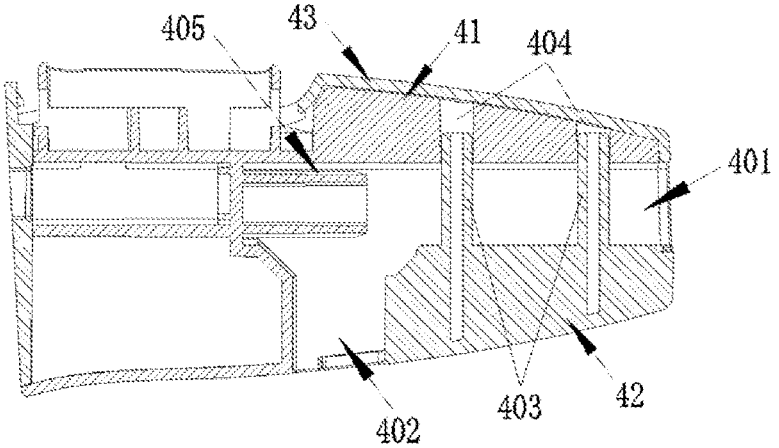
FIG. 23 is a cross-sectional view of FIG. 21.
Figure 24:
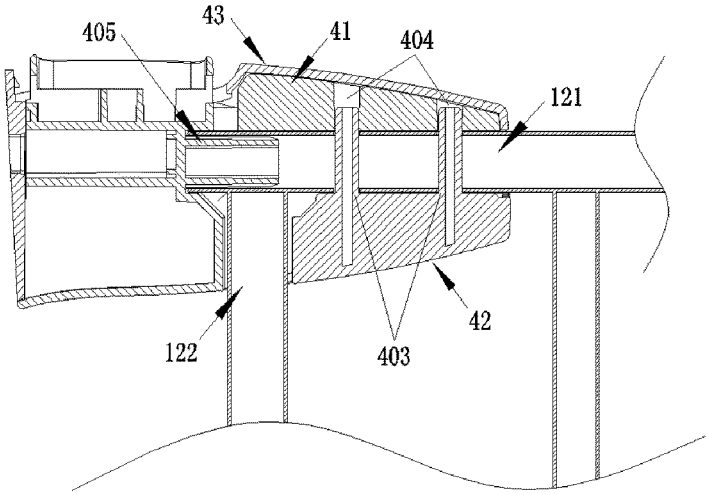
FIG. 24 is a cross-sectional view of the connection mechanism fitted to the gate assembly in the embodiment of FIG. 16.
Figure 25:
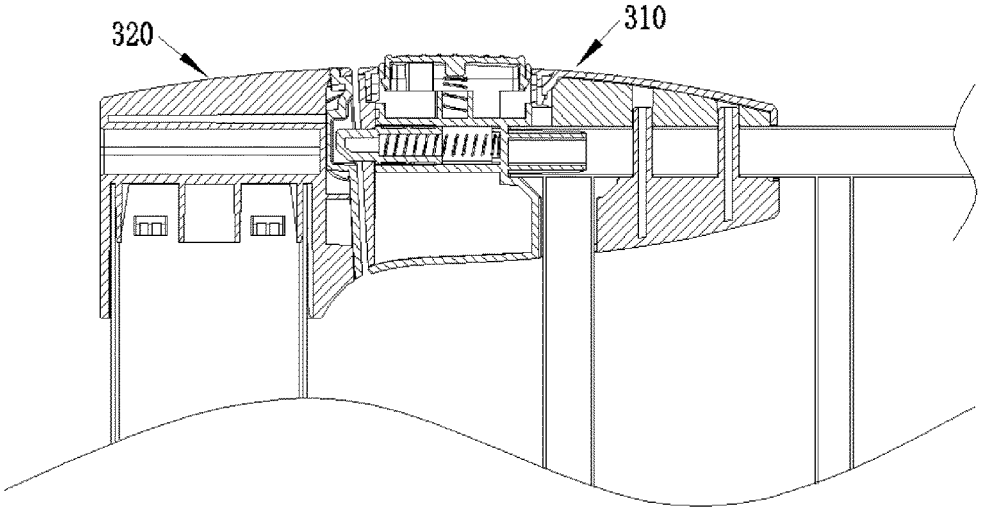
FIG. 25 is a cross-sectional view showing the cooperation between the limiting mechanism and the fence gate of the embodiment of FIG. 13.
Figure 26:
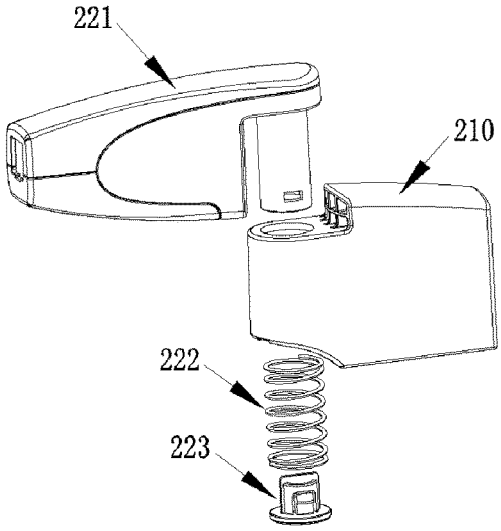
FIG. 26 is a schematic structural exploded view of main components of the upper rotating shaft of the embodiment of FIG. 13.
Figure 27:
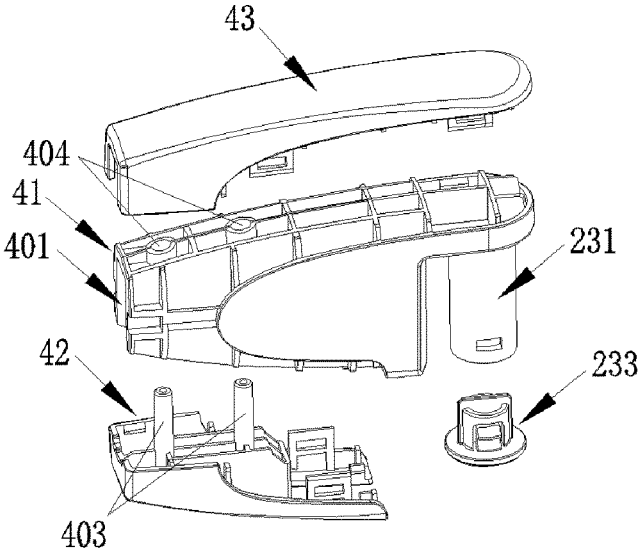
FIG. 27 is a schematic structural exploded view of an adapter of the embodiment of FIG. 26.
Figure 28:
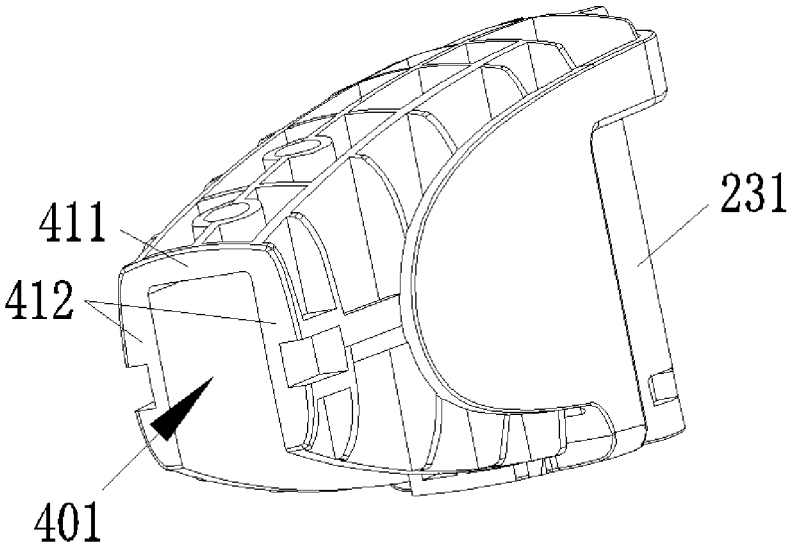
FIG. 28 is a schematic structural view of a first body of FIG. 27.
Figure 29:
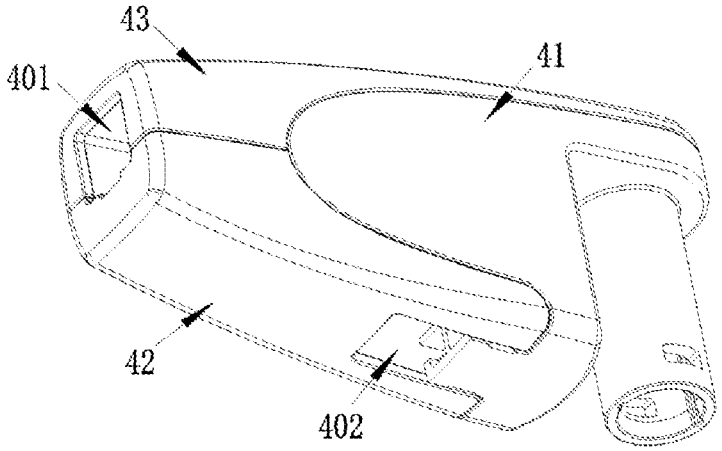
FIG. 29 is a schematic structural view of an adapter connection mechanism of FIG. 26.
Figure 30:
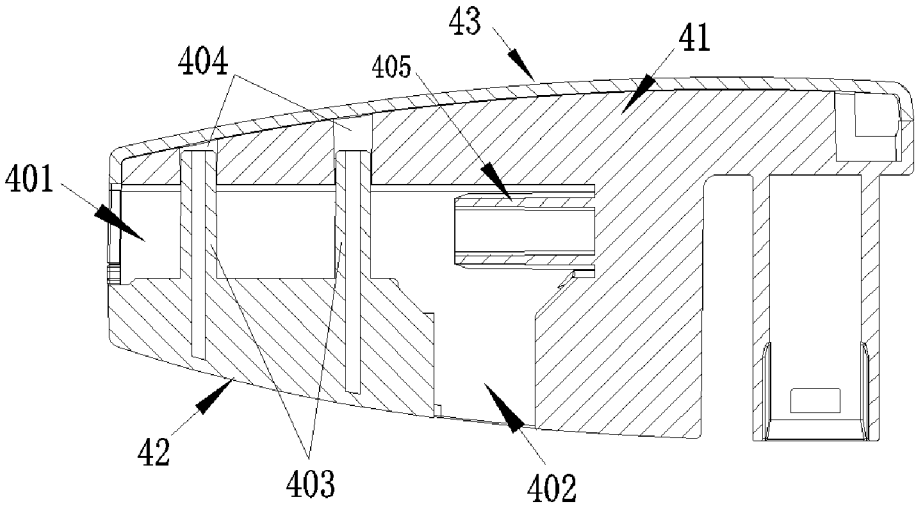
FIG. 30 is a cross-sectional view of the first body of FIG. 26.
Figure 31:
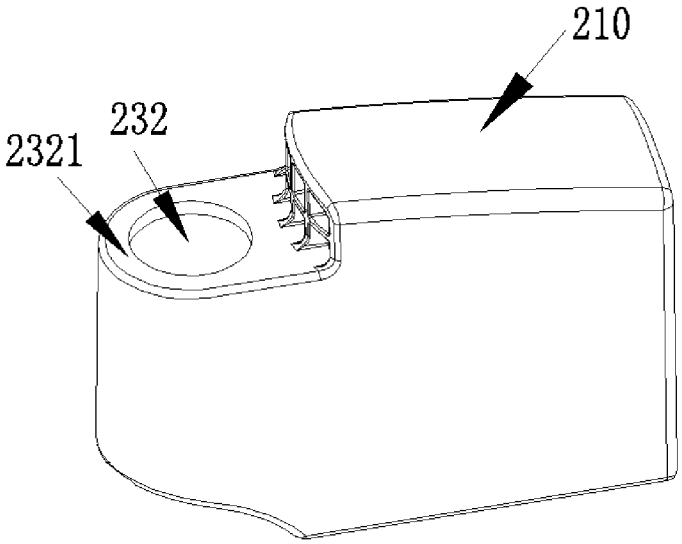
FIG. 31 is a schematic structural view of the rotating shaft seat of the embodiment of FIG. 13.

More preferably, the chamber 401 is also internally provided with a frame fixing seat 405, so that a front end of the first frame 121 is fitted into the chamber 401 and further fixed by the frame fixing seat 405 when the connection mechanism is fitted to the gate assembly; and the frame fixing seat 405 may be a clamping slot matching an outer contour of the gate frame, a clamping seat cooperating with an end of the gate frame or other similarly shaped components capable of fixing the front end of the first frame 121. For example, FIGS. 23 and 30 show a frame fixing seat in the form of a clamping seat, which enhances the fixing effect on the first frame 121 by being disposed in a hollow cavity at the front end of the first frame 121.

Moreover, the chamber 401 is completely arranged in the first body 41. For this reason, the first body 41 comprises one plane portion 411 and two side portions 412 which are enclosed together to form the chamber 401 (of course, the chamber 401 is still jointly formed by the second body 42, but no special chamber structure is arranged in the second body 42). More preferably, the first body 41 further comprises several reinforcing ribs 413 which are arranged on inner or outer surfaces of the plane portion 411, the side portions 412 or other components, thereby increasing the structural strength of the plane portion 411 or the side portions 412. For example, as shown in the related drawings, several reinforcing ribs 413 are arranged at appropriate positions outside the plane portion 411 and the side portions 412 and inside the chamber 401 to enhance the structural strength of the first body 41. Moreover, the connection mechanism may further comprise a third body 43 which is fitted outside the first body 41, so that the second body 42 or the third body 43 can cover the reinforcing ribs 413 on the outer surface of the first body 41, which provides the connection mechanism with an aesthetic overall appearance and is also more conducive to daily cleaning.

Of course, the cooperation among the three bodies is preferably achieved by means of engagement, screwing, hot melting or the like, wherein engagement is the most convenient and practical. Although an engaging structure is not used in an existing connection mechanism due to the connection fastness, the connection mechanism of the invention is designed with a special structure so that the engaging structure is not directly stressed, thereby improving the overall structural strength and the connection fastness of the connection mechanism. The connection manner of engagement is used to fix the fence gate components for the first time. The production and assembly costs are reduced while considering the overall structural strength, and the material and color of the adapter 220 can also be correspondingly selected. Therefore, the above design is an effective and practical structural design.

In addition, a second cavity 402 for fixing a second frame 122 of the gate assembly is also formed between the first body 41 and the second body 42, so that both the first frame 121 and the second frame 122 are connected to the connection mechanism, and the connection mechanism is firmly fixed to a horizontal frame and a vertical frame (i.e. the first frame 121 and the second frame 122) of the gate assembly. In this way, the spacing between the frames of the fence gate as a whole is desirable, thus avoiding safety hazards due to an excessively large gap. Although in the drawings of the invention, the connection mechanism is fixed to the horizontal frame (i.e. the first frame 121) of the gate assembly, it is not limited thereto in practical applications, and it is also feasible in practical applications to interchange the two frames or provide an additional frame connected to the gate assembly.

A fence gate limiting method is mainly based on the above fence gate assembly and comprises the following steps.

A fence gate assembly is configured to comprise an outer frame assembly 11 and a gate assembly 12, the gate assembly 12 is openably or closably arranged in the outer frame assembly 11, and a limiting mechanism is arranged between the outer frame assembly 11 and the gate assembly 12; wherein the limiting mechanism comprises a first limiting assembly 310 and a second limiting assembly 320, the first limiting assembly 310 comprises a lock tongue 312 and an actuating member 311, and the second limiting assembly 320 comprises a limiting seat 321; and the limiting seat 321 comprises a first limiting seat 3211, and the fence gate limiting mechanism further comprises a guiding portion 3213 arranged on the limiting seat 321 or the lock tongue 312. Of course, the fence gate assembly can also be configured to comprise other related structures in the above fence gate assembly product, or other necessary or optional functional components in the prior art.

The lock tongue 312 is configured to be fitted into the first limiting seat 3211 and to form primary limiting and secondary limiting, wherein the primary limiting is controlled by the actuating member 311 while the secondary limiting is acted on and driven by the guiding portion 3213; upon unlocking, the actuating member 311 is manipulated to drive the lock tongue 312 to be displaced in the first limiting seat 3211 to enable primary unlocking, so that the guiding portion 3213 is in a finable state; and when the unlocked state is maintained, the first limiting assembly 310 is driven to be longitudinally displaced relative to the second limiting assembly 320, and the lock tongue 312 is further moved to be completely disengaged from the limiting seat 321 by the guiding action of the guiding portion 3213 to enable secondary unlocking, so that the first limiting assembly 310 and the second limiting assembly 320 are unlocked. More preferably, the specific manner in which the actuating member 311 drives the lock tongue 312 is as follows: the displacement direction of the actuating member 311 is the same as the telescopic direction of the lock tongue 312, thereby driving the lock tongue to contract into the first limiting seat 3211 to enable primary unlocking; or the displacement direction of the actuating member 311 is different from the telescopic direction of the lock tongue 312, and the displacement of the actuating member 311 is converted into the telescopic movement of the lock tongue 312 by the two inclined or curved surfaces arranged on the actuating member 311 and the lock tongue 312 respectively, thereby driving the lock tongue to contract into the first limiting seat 3211 to enable primary unlocking. Most preferably, springs 315 can also be arranged between the actuating member 311 and the first limiting assembly 310, and between the lock tongue 312 and the first limiting assembly 310, so that both the actuating member 311 and the lock tongue 312 can be automatically reset.

In some embodiments, the limiting seat 321 is also configured to further comprise a second limiting seat 3212, wherein the first limiting seat 3211 and the second limiting seat 3212 are adjacently arranged; the depth of the first limiting seat 3211 is greater than the depth of the second limiting seat 3212, and the lock tongue 312 forms primary limiting when fitted to the first limiting seat 3211 and secondary limiting when fitted to the second limiting seat 3212; upon unlocking, the actuating member 311 is manipulated to drive the lock tongue 312 to be unlocked from the first limiting seat 3211 and limited in the second limiting seat 3212, so that the guiding portion 3213 is in a fittable state, thereby enabling primary unlocking; and the lock tongue 312 is fitted to an inner wall of the second limiting seat 3212 to maintain the unlocked state, the first limiting assembly 310 is driven to be longitudinally displaced relative to the second limiting assembly 320, and the lock tongue 312 is disengaged from the second limiting seat 3212 due to the guiding action of the guiding portion 3213 to enable secondary unlocking, so that the first limiting assembly 310 and the second limiting assembly 320 are unlocked.

It can be seen that the limiting mechanism comprises two operations upon unlocking: the first step (primary unlocking): the actuating member 311 controls the lock tongue 312 to be unlocked from the first limiting seat 3211, and the lock tongue is limited in the second limiting seat 3212; and the second step (secondary unlocking): the actuating member 311 is maintained in the unlocked state, so that the first limiting assembly 310 is longitudinally moved relative to the second limiting assembly 320, and the lock tongue 312 is further contracted to be completely disengaged from the limiting seat 321 due to the action of the guiding portion 3213, thereby unlocking the limiting between first limiting assembly 310 and the second limiting assembly 320.

In some other preferred embodiments, the guiding portion 3213 is configured to be an inclined or curved surface which is arranged at the top or bottom of the limiting seat 321, or at the top or bottom of the lock tongue 312; and in the case of secondary limiting, the longitudinal relative displacement of the first limiting assembly 310 relative to the second limiting assembly 320 can drive the lock tongue 312 to contract. In addition, as described above, the second limiting seat 3212 can also be configured to be removed; moreover, the guiding portion 3213 can also be arranged below.

In some other embodiments, the second limiting assembly 320 is configured to mainly consist of a second limiting body 323 and a limiting member 324 that are fixedly connected, wherein the second limiting body 323 and the limiting member 324 are preferably fixedly connected by means of engagement, screwing or hot melting to form the second limiting assembly 320; and the second limiting body 323 is preferably fixedly connected to an outer frame of a fence gate by means of engagement, screwing or the like.

In some other preferred embodiments, the method further comprises: configuring the adapter 220 and the first limiting assembly 310 to be connected to the gate assembly 12 by a special connection mechanism; and more specifically, the shaft body 231 of the adapter 220, and an integral functional member formed by the actuating member 311 and the lock tongue 312 of the first limiting assembly 310 are respectively arranged on their respective connection mechanisms. Of course, it is also possible that one of the adapter and the first limiting assembly is arranged via the connection mechanism.

The connection mechanism is configured to comprise a first body 41 and a second body 42 that are fixedly connected to form the entire connection mechanism, wherein the first body 41 and the second body 42 are preferably fixedly connected by means of engagement, screwing or hot melting, among which engagement is the most convenient and practical; and a chamber 401 for providing a first frame 121 of the gate assembly therein is formed between the first body 41 and the second body 42, and the first body 41 and the second body 42 are correspondingly provided with a fixing post 403 and a fixing hole 404 respectively, so that the fixing post 403 penetrates through the first frame 121 and is fixed into the fixing hole 404 when the connection mechanism is fitted to the gate assembly, and thus the connection mechanism is firmly fixed to the frame of the gate. More preferably, the chamber 401 is also internally provided with a frame fixing seat 405, so that a front end of the first frame 121 is fitted into the chamber 401 and further fixed by the frame fixing seat 405 when the connection mechanism is fitted to the gate assembly; and the frame fixing seat 405 may be a clamping slot matching an outer contour of the gate frame, a clamping seat cooperating with an end of the gate frame or other similarly shaped components capable of fixing the front end of the first frame 121. For example, FIGS. 23 and 30 show a frame fixing seat in the form of a clamping seat, which enhances the fixing effect on the first frame 121 by being disposed in a hollow cavity at the front end of the first frame 121.

Moreover, the chamber 401 can also be completely arranged in the first body 41. For this reason, the first body 41 comprises one plane portion 411 and two side portions 412 which are enclosed together to form the chamber 401 (of course, the chamber 401 is still jointly formed by the second body 42, but no special chamber structure is arranged in the second body 42). More preferably, the first body 41 is also arranged to comprise several reinforcing ribs 413 which are arranged on inner or outer surfaces of the plane portion 411, the side portions 412 or other components, thereby increasing the structural strength of the plane portion 411 or the side portions 412. For example, as shown in the related drawings, several reinforcing ribs 413 are arranged at appropriate positions outside the plane portion 411 and the side portions 412 and inside the chamber 401 to enhance the structural strength of the first body 41. Moreover, the connection mechanism can also be arranged to comprise a third body 43 which is fitted outside the first body 41, so that the second body 42 or the third body 43 can cover the reinforcing ribs 413 on the outer surface of the first body 41, which provides the connection mechanism with an aesthetic overall appearance and is also more conducive to daily cleaning.

In addition, a second cavity 402 for fixing a second frame 122 of the gate assembly can also be configured to be formed between the first body 41 and the second body 42, so that both the first frame 121 and the second frame 122 are connected to the connection mechanism, and the connection mechanism is firmly fixed to a horizontal frame and a vertical frame (i.e. the first frame 121 and the second frame 122) of the gate assembly. In this way, the spacing between the frames of the fence gate as a whole is desirable, thus avoiding safety hazards due to an excessively large gap. Although in the drawings of the invention, the connection mechanism is fixed to the horizontal frame (i.e. the first frame 121) of the gate assembly, it is not limited thereto in practical applications, and it is also feasible in practical applications to interchange the two frames or provide an additional frame connected to the gate assembly. In addition, the limiting scheme can also be correspondingly configured in combination with the related structures or principles of the above fence gate assembly.

The invention claimed is:

1. A fence gate limiting mechanism, comprising:

a first limiting assembly arranged on a gate assembly, wherein the first limiting assembly comprises a lock tongue and an actuating member configured to drive the lock tongue to be displaced;

a second limiting assembly arranged on an outer frame assembly, wherein the first limiting assembly and the second limiting assembly are configured to engage with each other to lock rotation of the gate assembly in the case that the gate assembly is in a closed position of the outer frame assembly, and the second limiting assembly comprises a limiting seat, the limiting seat comprising a first limiting seat; and a guiding portion, wherein the guiding portion is an inclined or curved surface, and is arranged on a top or bottom of the limiting seat or a top or bottom of the lock tongue;

wherein the lock tongue is fitted into the first limiting seat and forms primary limiting and secondary limiting, wherein the primary limiting is controlled by a displacement of the actuating member and the secondary limiting is controlled by a displacement of the lock tongue under driving of a longitudinal displacement of the first limiting assembly relative to the second limiting assembly when the guiding portion acts on the lock tongue; and upon unlocking, the actuating member drives the lock tongue to be partially displaced in the first limiting seat to enable primary unlocking, so that the lock tongue and the guiding portion transition to a fittable state; and when the unlocked state is maintained, the gate assembly is longitudinally pulled upward or pressed downward to drive the first limiting assembly to be longitudinally displaced relative to the second limiting assembly fixedly arranged on the outer frame assembly, and the lock tongue is completely disengaged from the limiting seat by guiding of the guiding portion to enable secondary unlocking, so that the first limiting assembly and the second limiting assembly are unlocked.

2. The fence gate limiting mechanism according to claim 1, wherein the limiting seat further comprises a second limiting seat, wherein the first limiting seat and the second limiting seat are adjacently arranged in a vertical direction, and the guiding portion is arranged at a top or a bottom of the second limiting seat; and a depth of the first limiting seat is greater than a depth of the second limiting seat, and the lock tongue forms primary limiting when fitted to the first limiting seat and secondary limiting when fitted to the second limiting seat; and upon unlocking, the actuating member drives the lock tongue to be disengaged from the first limiting seat into the second limiting seat by which the lock tongue is limited, so that the lock tongue and the guiding portion transition to the fittable state; and the gate assembly is longitudinally pulled upward or pressed downward to drive the first limiting assembly to be longitudinally moved relative to the second limiting assembly, thus enabling secondary unlocking by guiding of the guiding portion.

3. The fence gate limiting mechanism according to claim 2, wherein the second limiting assembly further comprises a limiting guiding portion, wherein the limiting guiding portion is an inclined surface or a curved surface which is arranged on at least one side of the second limiting assembly and arranged adjacently to the limiting seat.

4. The fence gate limiting mechanism according to claim 1, wherein the actuating member comprises a first guiding portion, the lock tongue comprises a second guiding portion, and the first guiding portion and the second guiding portion are inclined or curved surfaces; and the first guiding portion cooperates with the second guiding portion so that a longitudinal pressing displacement of the actuating member is converted into a horizontal telescopic displacement of the lock tongue.

5. The fence gate limiting mechanism according to claim 4, wherein the second guiding portion is arranged on two sides of the lock tongue, and two said first guiding portions are provided and arranged in cooperation with two second guiding portions; and the actuating member is configured to be higher than a surface of the first limiting assembly, and the lock tongue is unlocked from the first limiting seat when the actuating member is pressed to be flush with the surface of the first limiting assembly.

6. The fence gate limiting mechanism according to claim 1, wherein the actuating member is arranged in a displacement direction of the lock tongue.

7. The fence gate limiting mechanism according to claim 1, wherein the second limiting assembly further comprises a limiting guiding portion, wherein the limiting guiding portion is an inclined or curved surface which is arranged on at least one side of the second limiting assembly and arranged adjacently to the limiting seat.

8. The fence gate limiting mechanism according to claim 7, wherein the second limiting assembly comprises a second limiting assembly body and a limiting member which are fixedly connected to each other, and the limiting seat and the limiting guiding portion are arranged on the limiting member, wherein the second limiting assembly body and the limiting member are fixedly connected by engagement, screwing or hot melting to form the second limiting assembly.

9. A fence gate assembly, comprising:

an outer frame assembly, configured to be a U shape;

a gate assembly, arranged in the outer frame assembly;

an upper rotating shaft mechanism, comprising a rotating shaft seat and an adapter, wherein adapter is connected to the gate assembly by a fence gate connection mechanism;

a lower rotating shaft mechanism;

a limiting mechanism; and a fence gate limiting mechanism;

wherein the fence gate connection mechanism comprises a first body and a second body which are fixedly connected to form the connection mechanism; a chamber for providing a first frame of the gate assembly therein is formed between the first body and the second body, and the first body and the second body are also respectively provided with a fixing post and a fixing hole; and the fixing post penetrates through the first frame and is fitted into the fixing hole when the fence gate connection mechanism is fitted to the gate assembly;

the fence gate limiting mechanism comprises:

a first limiting assembly arranged on the gate assembly, wherein the first limiting assembly comprises a lock tongue and an actuating member configured to drive the lock tongue to be displaced;

a second limiting assembly arranged on the outer frame assembly, wherein the first limiting assembly and the second limiting assembly are configured to engage with each other to lock rotation of the gate assembly in the case that the gate assembly is in a closed position of the outer frame assembly, and the second limiting assembly comprises a limiting seat, the limiting seat comprising a first limiting seat; and a guiding portion, wherein the guiding portion is an inclined or curved surface, and is arranged on a top or a bottom of the limiting seat or on a top or bottom of the lock tongue;

wherein the lock tongue is fitted into the first limiting seat and forms primary limiting and secondary limiting, wherein the primary limiting is controlled by a displacement of the actuating member and the secondary limiting is controlled by a displacement of the lock tongue under driving of a longitudinal displacement of the first limiting assembly relative to the second limiting assembly when the guiding portion acts on the lock tongue; and upon unlocking, the actuating member drives the lock tongue to be partially displaced in the first limiting seat to enable primary unlocking, so that the lock tongue and the guiding portion transition to a fittable state; and when the unlocked state is maintained, the gate assembly is longitudinally pulled upward or pressed downward to drive the first limiting assembly to be longitudinally displaced relative to the second limiting assembly fixedly arranged on the outer frame assembly, and the lock tongue is completely disengaged from the limiting seat by guiding of the guiding portion to enable secondary unlocking, so that the first limiting assembly and the second limiting assembly are unlocked.

10. The fence gate assembly according to claim 9, wherein the chamber is also internally provided with a frame fixing seat, so that the first frame is fitted into the chamber and further fixed by the frame fixing seat when the fence gate connection mechanism is fitted to the gate assembly.

11. The fence gate assembly according to claim 10, wherein the frame fixing seat is a clamping slot matching an outer contour of the first frame or a clamping seat cooperating with an end of the first frame.

12. The fence gate assembly according to claim 9, wherein the chamber; the first body comprises one plane portion and two side portions which are enclosed to form the chamber; the first body further comprises several reinforcing ribs which are arranged on at least one of the plane portion and the side portions; and the fence gate connection mechanism further comprises a third body which is fitted outside the first body.

13. The fence gate assembly according to claim 12, wherein the first body, the second body and the third body are fixed by engagement.

14. The fence gate assembly according to claim 9, wherein the first limiting assembly and the second limiting assembly are respectively arranged on the gate assembly and the outer frame assembly, and cooperate with each other to limit the gate assembly.

15. The fence gate assembly according to claim 14, wherein the first limiting assembly is connected to the gate assembly via the fence gate connection mechanism.

16. A fence gate limiting method, comprising:

configuring a fence gate assembly to comprise an outer frame assembly and a gate assembly, and providing a limiting mechanism between the outer frame assembly and the gate assembly; wherein the limiting mechanism comprises a first limiting assembly and a second limiting assembly, the first limiting assembly comprises a lock tongue and an actuating member, and the second limiting assembly comprises a limiting seat; and the limiting seat comprises a first limiting seat, and the fence gate limiting mechanism further comprises a guiding portion arranged on the limiting seat or the lock tongue, wherein the guiding portion is an inclined or curved surface, and is arranged on a top or bottom of the limiting seat or a top or bottom of the lock tongue;

configuring the lock tongue to be fitted into the first limiting seat and to form primary limiting and secondary limiting, wherein the primary limiting is controlled by a displacement of the actuating member and the secondary limiting is controlled by a displacement of the lock tongue under driving of a longitudinal displacement of the first limiting assembly relative to the second limiting assembly when the guiding portion acts on the lock tongue;

wherein upon unlocking, the actuating member is manipulated to drive the lock tongue to be partially displaced in the first limiting seat to enable primary unlocking, so that the lock tongue and the guiding portion transition to a fittable state; and when the unlocked state is maintained, the gate assembly is longitudinally pulled upward or pressed downward to drive the first limiting assembly to be longitudinally displaced relative to the second limiting assembly fixedly arranged on the outer frame assembly, and the lock tongue is completely disengaged from the limiting seat by guiding of the guiding portion to enable secondary unlocking, so that the first limiting assembly and the second limiting assembly are unlocked.

17. The method according to claim 16, wherein the limiting seat is configured to further comprise a second limiting seat, wherein the first limiting seat and the second limiting seat are adjacently arranged in a vertical direction, and the guiding portion is arranged at a top or bottom of the second limiting seat; and a depth of the first limiting seat is greater than a depth of the second limiting seat, and the lock tongue forms primary limiting when fitted to the first limiting seat and secondary limiting when fitted to the second limiting seat; and upon unlocking, the actuating member is manipulated to drive the lock tongue to be disengaged from the first limiting seat into the second limiting seat by which the lock tongue is limited, so that the lock tongue and the guiding portion transition to the fittable state, thereby enabling primary unlocking; and the gate assembly is longitudinally pulled upward or pressed downward to drive the first limiting assembly to be longitudinally y displaced so that the lock tongue is disengaged from the second limiting seat by guiding of the guiding portion, thereby enabling secondary unlocking.

18. The method according to claim 16, wherein a limiting guiding portion is further arranged on at least one side of the second limiting assembly during configuring the fence gate assembly;

wherein the limiting guiding portion is an inclined or curved surface, which is arranged adjacently to the limiting seat, so that the lock tongue is automatically contracted and fitted into the limiting seat due to guiding of the limiting guiding portion.

19. The method according to claim 16, wherein the displacement direction of the actuating member is the same as a telescopic direction of the lock tongue, thereby driving the lock tongue to contract into the first limiting seat to enable primary unlocking; or the displacement direction of the actuating member is different from the telescopic direction of the lock tongue, and a longitudinal displacement of the actuating member is converted into a horizontal telescopic movement of the lock tongue by the two inclined or curved surfaces arranged on the actuating member and the lock tongue respectively, thereby driving the lock tongue to contract into the first limiting seat to enable primary unlocking.

20. The method according to claim 16, further comprising: configuring at least one of an adapter and a second limiting assembly to be arranged on the gate assembly via a connection mechanism; wherein the connection mechanism comprises a first body and a second body, a chamber for providing a first frame of the gate assembly therein being formed between the first body and the second body, and the first body and the second body being respectively correspondingly provided with a fixing post and a fixing hole, so that the fixing post penetrates through the first frame and is fixed into the fixing hole when the fence gate connection mechanism is fitted to the gate assembly.

* * * * *